US006439102B1

(12) United States Patent
Matsuzaki et al.

(10) Patent No.: US 6,439,102 B1
(45) Date of Patent: Aug. 27, 2002

(54) TILT CONTROL DEVICE FOR FORK LIFT TRUCK

(75) Inventors: Takeharu Matsuzaki, Aichi-ken (JP); Shigeto Nakajima, Nagano-ken (JP); Makio Tsukada, Nagano-ken (JP)

(73) Assignees: Kabushiki Kaisha Toyoda Jidoshokki Seisakusho, Kariya (JP); Nishina Industrial Co., Ltd., Kamiminochi-gun (JP)

( * ) Notice: Subject to any disclaimer, the term of this patent is extended or adjusted under 35 U.S.C. 154(b) by 0 days.

(21) Appl. No.: 09/610,792

(22) Filed: Jul. 6, 2000

(30) Foreign Application Priority Data

Jul. 6, 1999 (JP) ..... 11-192029

(51) Int. Cl.[7] ..... F15B 13/04; F15B 11/08
(52) U.S. Cl. ..... 91/445; 91/447
(58) Field of Search ..... 91/445, 447

(56) References Cited

U.S. PATENT DOCUMENTS 6,164,415 A * 12/2000 Takeuchi et al. ..... 187/224

FOREIGN PATENT DOCUMENTS

JP 10-265194 10/1998
JP 10-330096 12/1998

* cited by examiner

*Primary Examiner*—F. Daniel Lopez
*Assistant Examiner*—Michael Leslie
(74) *Attorney, Agent, or Firm*—Morgan & Finnegan, LLP

(57) ABSTRACT

A tilt control device for a fork lift truck comprises a tilt spool for operating the tilt cylinder, a pilot operation type flow rate control valve connected to the hydraulic pump via the tilt spool and adapted to be switched between a fully opened position and a half opened position which are different in opening from each other in response to addition/deletion of a pilot pressure, a pilot operation type logic valve disposed between the rod side oil compartment of the tilt cylinder and the flow rate control valve and adapted to permit hydraulic oil to flow into the rod side oil compartment and to be operated so as to open/close relative to hydraulic oil flowing out of the rod side oil compartment in response to the addition/deletion of the pilot pressure, and an electromagnetic switching valve for controlling the addition/deletion of the pilot pressure to the flow rate control valve and the logic valve.

9 Claims, 3 Drawing Sheets

TILT CONTROL DEVICE FOR FORK LIFT TRUCK

BACKGROUND OF THE INVENTION

1. Field of the Invention

The present invention relates to a tilt control technique for controlling the tilting operation of masts of a fork lift truck, and more particularly to the flow rate control of a hydraulic control valve for controlling the operation of a tilt cylinder.

2. Description of the Related Art

In a conventional fork lift truck, there is provided a tilt cylinder control device comprising a forward tilting angle control function for putting limitations on the forward tilting angle of masts depending on lift height and/or load when the masts are tilted forward and a rearward tilting speed control function for slowing the rearward tilting speed of the masts when the masts are tilted rearward under a high lift height and high loaded condition.

These controls can be attained by providing on a passage connecting a rod side oil chamber of a tilt cylinder for tilting the mast with a tilt spool for operating the tilt cylinder a control valve capable of regulating the flow rate of hydraulic oil and of stopping a tilt cylinder at a predetermined position within its range of stroke.

A tilt control device comprising a control valve as described above is disclosed in, for example, Japanese Patent Laid-open No. 10-330096. In the tilt control valve disclosed in the unexamined patent publication, a proportional electromagnetic type flow rate control valve is provided on the aforesaid passage, and the proportional electromagnetic type flow rate control valve comprises a flow rate control part and a solenoid part for generating a pilot pressure, wherein the pilot pressure acting on the flow rate control part is controlled with an electromagnetic force (which is in proportion to current flowing through the coil) generated at the solenoid part, and wherein the displacement (opening) of a spool of the flow rate control part is determined by the balance between the pilot pressure and a spring force, whereby a flow rate in proportion to current is obtained.

With a proportional electromagnetic type control valve such as for use in the aforesaid tilt control device, however, there is a drawback that it is complicated in construction and is high in cost. In addition, with the proportional electromagnetic type control valve, the opening can be changed in a continuous fashion to thereby attain a fine control, but in contrast, there is a strong likelihood that a sticking phenomenon occurs.

SUMMARY OF THE INVENTION

The present invention has been made in view of the above problem, and an object thereof is to provide a tilt control technique for simplifying the construction of a tilt control device and for reducing cost for producing the same, while ensuring that the conventional masts forward tilting angle control function and rearward tilting speed control function are maintained.

According to the present invention, there is provided a tilt control device for a fork lift truck for allowing hydraulic oil received in a tank to flow into one of a rod side oil compartment and a bottom side oil compartments of a tilt cylinder using a hydraulic pump for tilting masts of the fork lift truck, the control device comprising:

a tilt spool for operating the tilt cylinder;

a pilot operation type flow rate control valve connected to the hydraulic pump via the tilt spool and adapted to be switched between a fully opened position and a half opened position which are different in opening from each other in response to addition/deletion of a pilot pressure;

a pilot operation type logic valve disposed between the rod side oil compartment of the tilt cylinder and the flow rate control valve and adapted to permit hydraulic oil to flow into the rod side oil compartment and to be operated so as to open/close relative to the hydraulic oil flowing out of the rod side oil compartment in response to the addition/deletion of the pilot pressure; and an electromagnetic switching valve for controlling the addition/deletion of the pilot pressure to the flow rate control valve and the logic valve.

Consequently, according to the present invention, in tilting operation of the masts, when the electromagnetic switching valve for pilot operation is operated for switching, the pilot pressure is added or deleted relative to the flow rate control valve, whereby the flow rate control valve is switched to its fully opened position or half opened position. This switching of the flow rate control valve then leads to the control of the amount of hydraulic oil for the rod side oil compartment of the tilt cylinder in two ways; large and small, whereby the operating speed of the tilt cylinder is in turn switched between two speeds; high and low.

Thus, in operating the masts so as to tilt them rearward, the electromagnetic switching valve is operated for switching in response to respective detection signals representing rearward tilting operation, high lift height and high load, and the flow rate control valve is then switched from the fully opened position to the half opened position, thereby making it possible to control the rearward tilting speed of the masts.

In addition, in operating the masts so as to tilt them forward, when the electromagnetic switching valve is operated for switching, the pilot operation type changeover valve is changed over to a position where a pilot pressure is added or to another position where the pilot pressure is deleted relative to a poppet valve for an opening or closing operation, and this changing over of the positions of the changeover valve results in opening or closing of the poppet valve. In other words, the hydraulic oil in the rod side oil compartment is permitted to or prohibited from flowing out thereof by operating the electromagnetic switching valve for switching, whereby the tilt cylinder is put in operation or brought to a stop.

Thus, in forward tilting operation of the masts, the forward tilting angle can be controlled by switching the electromagnetic switching valve to a position to stop the operation of the tilt cylinder in response to detection signals representing forward tilting operation, high lift height and high load, and additionally a detection signal representing that the tilt angle of the masts reaches a given value.

As has been described heretofore, according to the present invention, functions equivalent to those provided by the conventional device can be secured through a combination of the ON/OFF type flow rate control valve, the changeover valve and the electromagnetic switching valve which are all low in cost and simple in construction, and moreover since the respective valves can be operated through a simple ON/OFF operation, there is less risk of generation of failure, thereby making it possible to improve the reliability.

Furthermore, according to the present invention, a fork lift truck can be provided which is fitted to the tilt control device having the specific features described above.

DESCRIPTION OF THE PREFERRED EMBODIMENTS

Figure 1:
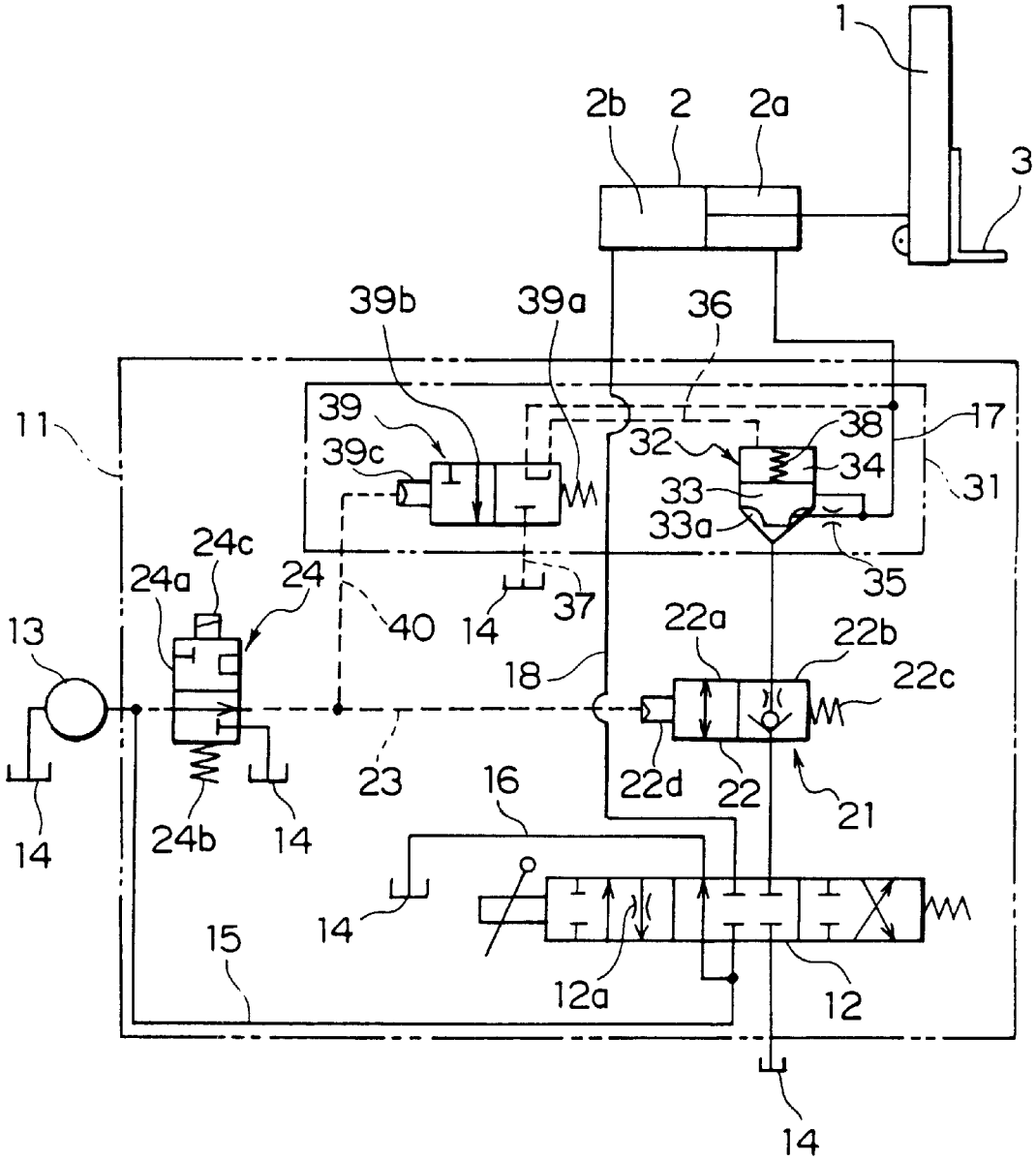
FIG. 1 is a hydraulic circuit diagram showing the construction of a tilt control device according to an embodiment of the present invention.
Figure 2:
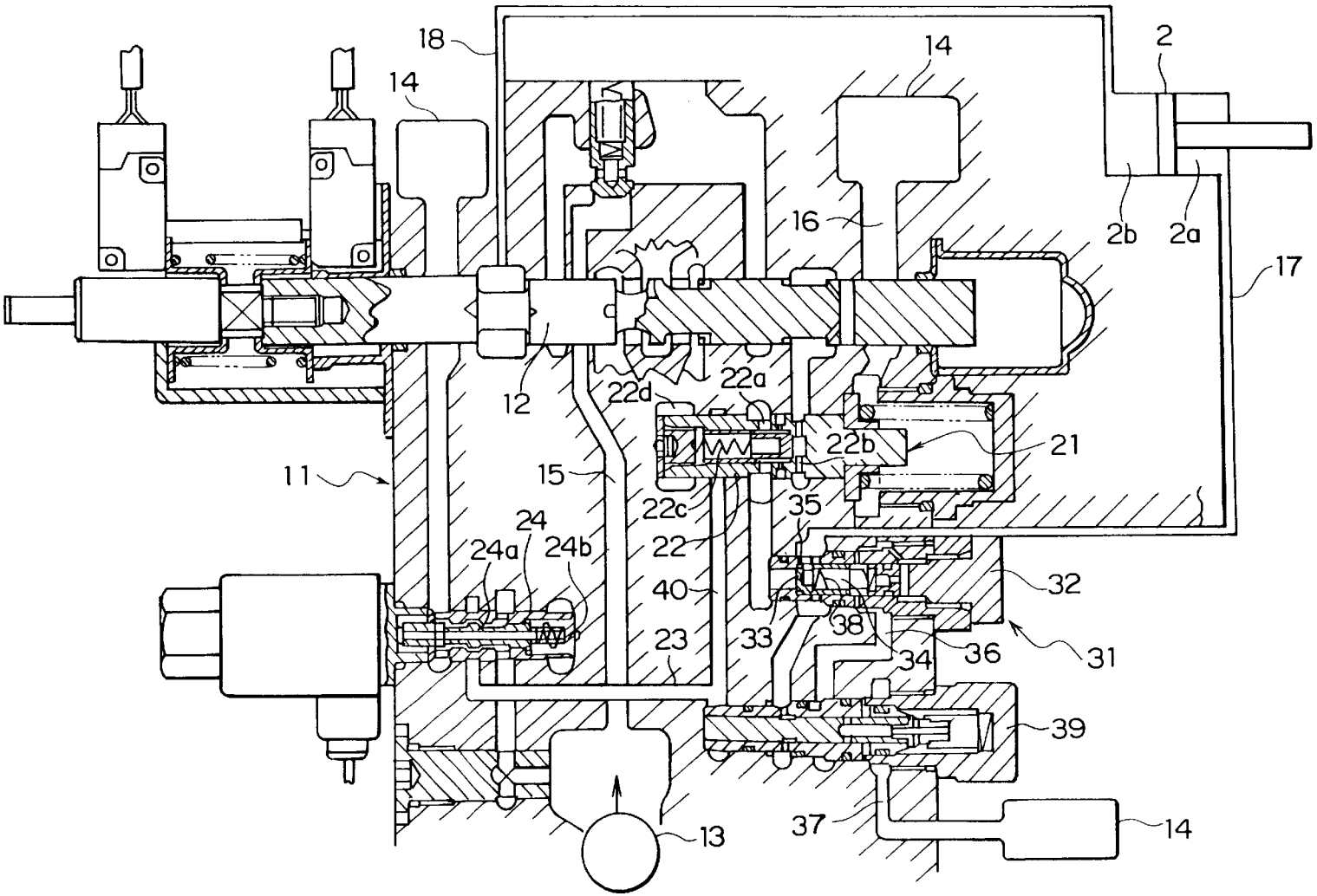
FIG. 2 is a sectional view showing an oil control valve used in the tilt control device in FIG. 1.

As shown in the drawings, an oil control valve 11 comprises a manual tilt spool 12 for operating a tilt cylinder 2 for tilting masts 1 of a fork lift truck. The tilt spool 12 is of a three-position type and is normally held at a neutral position as shown in the figure, and hydraulic oil sent from a hydraulic pump 13 through a supply passage 15 is constructed so as to return to a tank 14 through a return passage 16. In addition, the tilt spool 12 is connected to a rod side oil chamber 2*a* and a bottom side oil chamber 2*b* of the tilt cylinder 2 via passages 17, 18, respectively.

Provided on the rod side passage 17 is a pilot operation type flow rate control valve 21 which is a two-position valve that can be switched between a fully opened position and a half opened position.

The flow rate control valve 21 comprises a spool 22 having two large and small passages having different flow path cross-sectional areas, which are a full open passage 22*a* and a half open passage 22*b*. The spool 22 is normally held at the half opened position with a spring 22*c* where the half open passage 22*b* communicates with the rod side passage 17. Then, when a pilot pressure is applied to a pilot compartment 22*d* through a first pilot passage 23 connected to the supply passage 15, the spool 22 is switched to the fully opened position where the full open passage 22*a* communicates with the rod side passage 17.

An electromagnetic switching valve 24 is provided on the first pilot passage 23. This electromagnetic switching valve 24 is of a normally opened type and is constructed such that when it is in an off state, the electromagnetic switching valve 24 is held by a spring 24*b* at a position where the spool 24*a* establishes a communication between the pilot passage 23 and the hydraulic pump 13, while when a solenoid 24*c* is excited (turned ON), the electromagnetic switching valve 24 is switched to a position where the spool 24*a* establishes a communication between the pilot passage 23 and the tank 14.

A logic valve 31 is provided on the rod side passage 17 between the flow rate control valve 21 and the tilt cylinder 2. This logic valve 31 permits the flow of hydraulic oil into the rod side oil chamber 2*a* and comprises a poppet valve 32 which is controlled to be opened and/or closed by the presence of pilot pressure when the hydraulic oil flows out and a changeover valve 39 for controlling the presence of action of pilot pressure.

Figure 3:
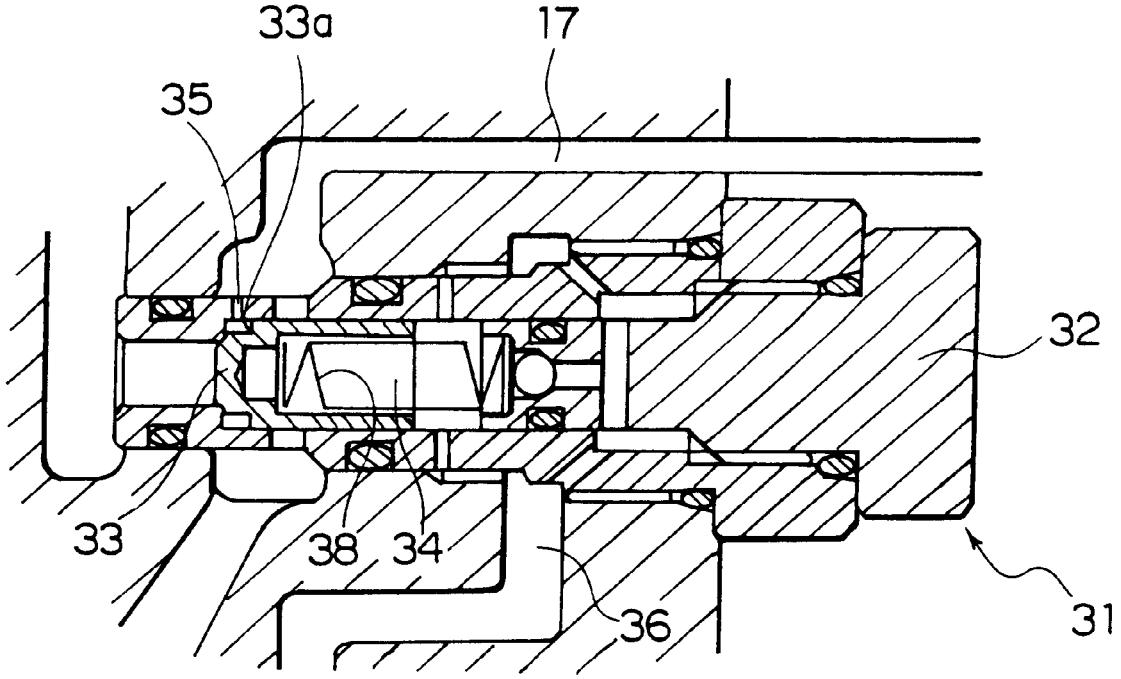
FIG. 3 is a sectional view showing a poppet valve used in the tilt control device in FIG. 1.

In other words, the poppet valve 32 comprises a poppet 33 for opening and closing the flow passage, and in a valve opening direction the flowing out oil acts on a stepped pressure receiving surface 33*a* formed on the outer circumference of the poppet 33 through an orifice 35, while in a valve closing direction a spring force of a spring 38 acts on the poppet 33 and the pilot pressure from the flowing out oil is applied to a pilot compartment 34 through a pilot passage 36 (refer to FIG. 3). By the changeover valve 39 provided on the pilot passage 36, the pilot passage 36 is connected with/isolated from a relief passage 37 communicating with the tank 14.

The changeover valve 39 has a spool 39*b* which is normally held by a spring 39*a* at a position where the pilot passage 36 is isolated from the relief passage 37 and, at the same time, is connected with the rod side passage 17, and the spool 39*b* is switched to a position where the pilot passage 36 is connected with the relief passage 37 when the pilot pressure is applied to a pilot compartment 39*c* through a second pilot passage 40 branched off from the first pilot passage 23.

The tilt control device according to the present invention is constructed as described above, and operation and effect thereof will be described below.

When the hydraulic pump 13 is driven by the engine (not shown) with the tilt spool 12 being held at the neutral position, hydraulic oil is sent under pressure from the tank 14 into the supply passage, and the hydraulic oil so sent then returns to the tank 14 through the return passage 16.

In such a state, in a case where the tilt spool 12 is tilted rearward, the hydraulic oil from the hydraulic pump 13 is sent to the rod side oil compartment 2*a* in the tilt cylinder 2 via the flow rate control valve 21 and the poppet valve 32 disposed along the rod side passage 17, and hydraulic oil in the bottom side oil compartment 2*b* is returned to the tank 14 through the bottom side passage 18. As a result, the tilt cylinder 2 operates in a contracting direction, whereby the masts 1 are tilted rearward.

When this occurs, with the solenoid 24c of the electromagnetic switching valve 24 being in an OFF state, since the first pilot passage 23 communicates with the hydraulic pump 13, the pilot pressure is added to the pilot compartment 22*d* of the flow rate control valve 21, and the spool 22 of the flow rate control valve 21 is switched to the fully opened position. Thus, in this case, the tilt cylinder 2 is tilted rearward at normal speed.

On the other hand, with the solenoid 24*c* of the electromagnetic switching valve 24 being in an ON state, the first pilot passage 23 then communicates with the tank 14, and since the pilot pressure in the pilot compartment 22*d* of the flow rate control valve 21 is deleted, the spool 22 of the flow rate control valve 21 is switched to the half opened position. Thus, in this case, the tilt cylinder 2 is tilted rearward at a speed slower than its normal speed.

Next, in a case where the tilt spool 12 is switched to a forward tilting side, hydraulic oil from the hydraulic pump 13 is sent to the bottom side oil chamber 2*b* of the tilt cylinder 2 through the bottom side passage 18. Then, the hydraulic oil acts on the stepped pressure receiving surface 33*a* of the poppet 33 through the orifice 35, while the hydraulic oil in the rod side oil compartment 2*a* is added as pilot pressure to the pilot compartment 34 of the poppet valve 32 through the pilot passage 36.

When this takes place, with the solenoid 24*c* of the electromagnetic switching valve 24 being in the OFF state, the pilot pressure is added to the pilot compartment 39*c* of the changeover valve 39 through the second pilot passage 40, and the changeover valve 39 is then switched to an open position, and since the pilot passage 36 of the poppet valve 32 then communicates with the tank 14 through the relief passage 37, the poppet 33 is opened by virtue of the force acting on the stepped pressure receiving surface 33*a*. Thus, hydraulic oil in the rod side oil compartment 2*a* flows out into the tank 14 via the poppet valve 32, the flow rate control valve 21 and the tilt spool 12, and the tilt cylinder 2 is caused to operate in its extending direction, whereby the masts 1 are tilted forward. Note that since the flow rate control valve 21 has already been switched to the fully opened positin, when this happens, therefore, the forward tilting speed of the masts 1 is regulated by throttling 12*a* provided on a return path of the tilt spool 12.

On the other hand, with the solenoid 24*c* of the electromagnetic switching valve 24 being in the ON state, since the second pilot passage 40 communicates with the tank 14 so that the pilot pressure in the pilot compartment 39*c* of the changeover valve 39 is deleted, the changeover valve 39 is switched to a closed position. This isolates the pilot passage 36 from the relief passage 37, and the pilot pressure is added to the pilot compartment 34 of the poppet valve 32. Namely, since pressures are applied to the poppet valve 32 from both the valve opening direction and the valve closing direction, the poppet valve 32 is balanced with respect to pressures acting thereon, and therefore the poppet 33 is pressed to close by virtue of the spring force of the spring 38.

Thus, when the electromagnetic switching valve 24 is switched on, the logic valve 31 is closed to thereby prevent hydraulic oil from flowing out of the rod side oil chamber 2*a,* the forward tilting movement of the masts 1 being thereby prevented.

As has been described heretofore, according to the present invention, by switching on or off the electromagnetic switching valve 24 or switching the same to the position where pilot pressure is added or to the position where the pilot pressure is deleted, when the masts are tilted rearward, the rearward tilting speed of the masts can be changed in two steps; high and low, and on the contrary, when the masts are tilted forward, switching can be effected between the state in which the masts can be tilted forward and the (stop) state in which the masts cannot be tilted forward.

Consequently, when the masts are tilted rearward, the rearward tilting speed control for the masts 1 can be effected in which the rearward tilting speed is made slower under the high lift height and heavy loaded condition than under the normal state by setting it such that the electromagnetic switching valve 24 is switched on in response to detection signals indicating, respectively, the mast rearward tilting, high lift height and heavily loaded condition in which a fork 3 is loaded.

On the other hand, when the masts are tilted forward, the forward tilting angle control for the masts 1 can be effected under the high lift height and heavy loaded condition by setting it such that the electromagnetic switching valve 24 is switched on in response to detection signals indicating, respectively, the mast forward tilting, high lift height and heavily loaded condition in which a fork 3 is loaded, and additionally in response to a detection signal indicating that the tilt angle of the mast reaches the predetermined value.

Moreover, for example, in a case where the mast forward tilting operation is carried out with a horizontal fork feeding switch being switched on which is provided at the bottom of a tilt operation lever, an automatic horizontal feeding control of the fork also can be effected by detecting suitably that the fork 3 reaches the horizontal position with a detector and setting the electromagnetic switching valve 24 such that the valve is switched on in response to what is detected by the detector.

Thus, according to the embodiment of the present invention, functions equivalent to those provided by the conventional device can be secured through a combination of the flow rate control valve 21, the changeover valve 39, and the electromagnetic switching valve 24 which are all ON/OFF type ones lower in cost and simpler in construction than the proportional electromagnetic type flow rate control valve. Moreover, since the respective valves adopt the simple ON/OFF operation, it is hard to suffer from a sticking phenomenon (a phenomenon in which the spool sticks with foreign matters present in oil), whereby there occurs less failure and it is possible to improve the reliability.

As has been described heretofore, according to the present invention, it is possible to provide the tilt control technique for a fork lift truckwhich can simplify the construction and reduce cost while securing the forward tilting angle control function and the rearward tilting speed control function for the masts which are equivalent in quality to those provided by the conventional technique.

What is claimed is:

1. A tilt control device for a fork lift truck for allowing hydraulic oil received in a tank to flow into one of a rod side oil compartment and a bottom side oil compartment of a tilt cylinder using a hydraulic pump for tilting masts of the fork lift truck, said control device comprising:

a tilt spool for operating said tilt cylinder;

a pilot operation type flow rate control valve connected to said hydraulic pump via said tilt spool and adapted to be switched between a fully opened position and a half opened position which are different in opening from each other in response to addition/deletion of a pilot pressure;

a pilot operation type logic valve disposed between said rod side oil compartment of said tilt cylinder and said flow rate control valve and adapted to permit hydraulic oil to flow into said rod side oil compartment and to be operated so as to open/close relative to hydraulic oil flowing out of said rod side oil compartment in response to the addition/deletion of the pilot pressure; and an electromagnetic switching valve for controlling the addition/deletion of the pilot pressure to said flow rate control valve and said logic valve, said logic valve including a poppet valve disposed between said rod side oil chamber of said tilt cylinder and said flow rate control valve, and a pilot operation type changeover valve for controlling the addition/deletion of the pilot pressure to said poppet valve for opening/closing thereof.

2. A tilt control device according to claim 1, wherein said electromagnetic valve adds the pressure of hydraulic oil sent from said hydraulic pump as the pilot pressure to said flow rate control valve and said changeover valve.

3. A tilt control device according to claim 1, wherein said changeover valve establishes/cuts off the communication between a pilot passage for guiding the pilot pressure to said poppet valve for opening/closing thereof and said tank.

4. A tilt control device according to claim 1, wherein said bottom side oil compartment of said tilt cylinder is connected to said hydraulic oil pump and said tank via said tilt spool.

5. A tilt control device for a fork lift truck for allowing hydraulic oil received in a tank to flow into one of a rod side oil compartment and a bottom side oil compartment of a tilt cylinder using a hydraulic pump for tilting masts of the fork lift truck, said control device comprising:

a tilt spool for operating said tilt cylinder;

a pilot operation type flow rate control valve connected to said hydraulic pump via said tilt spool, said flow rate control valve being a two-position valve with a full open passage and a half open passage, each passage having a different flow path cross-sectional area, in which the full open passage is connected to said tilt spool when a pilot pressure is applied thereto while the half open passage is connected to said tilt spool when a pilot pressure is deleted;

a pilot operation type logic valve disposed between said rod side oil compartment of said tilt cylinder and said flow rate control valve and adapted to permit hydraulic oil to flow into said rod side oil compartment and to be operated so as to open/close relative to hydraulic oil flowing out of said rod side oil compartment in response to the addition/deletion of the pilot pressure; and an on/off type electromagnetic switching valve for applying the pilot pressure to said flow rate control valve and said logic valve in an off state and deleting the pilot pressure to said flow rate control valve and said logic valve in an on state.

6. A tilt control device according to claim 5, wherein said logic valve comprises:

a poppet valve disposed between said rod side oil chamber of said tilt cylinder and said flow rate control valve, and a pilot operation type changeover valve for controlling the addition/deletion of the pilot pressure to said poppet valve for opening/closing thereof.

7. A tilt control device according to claim 6, wherein said electromagnetic valve adds the pressure of hydraulic oil sent from said hydraulic pump as the pilot pressure to said flow rate control valve and said changeover valve.

8. A tilt control device according to claim 6, wherein said changeover valve establishes/cuts off the communication between a pilot passage for guiding the pilot pressure to said poppet valve for opening/closing thereof and said tank.

9. A tilt control device according to claim 5, wherein said bottom side oil compartment of said lift cylinder is connected to said hydraulic oil pump and said tank via said tilt spool.

* * * * *